US007675468B2

(12) United States Patent
Ying

(10) Patent No.: US 7,675,468 B2
(45) Date of Patent: Mar. 9, 2010

(54) PORTABLE COMMUNICATION DEVICE WITH ULTRA WIDEBAND ANTENNA

(75) Inventor: Zhinong Ying, Lund (SE)

(73) Assignee: Sony Ericsson Mobile Communications AB, Lund (SE)

( * ) Notice: Subject to any disclaimer, the term of this patent is extended or adjusted under 35 U.S.C. 154(b) by 110 days.

(21) Appl. No.: 11/720,292

(22) PCT Filed: Oct. 27, 2005

(86) PCT No.: PCT/EP2005/011512

§ 371 (c)(1),
(2), (4) Date: May 25, 2007

(87) PCT Pub. No.: WO2006/056290

PCT Pub. Date: Jun. 1, 2006

(65) Prior Publication Data

US 2008/0030410 A1 Feb. 7, 2008

Related U.S. Application Data

(60) Provisional application No. 60/633,823, filed on Dec. 7, 2004.

(30) Foreign Application Priority Data

Nov. 29, 2004 (EP) ..... 04028215

(51) Int. Cl.
*H01Q 1/22* (2006.01)

(52) U.S. Cl. ..... 343/702; 343/700 MS; 343/826; 343/853; 343/895

(58) Field of Classification Search ..... 343/700 MS, 343/702, 795, 797, 829, 841, 846, 848, 826, 343/853, 873, 895
See application file for complete search history.

(56) References Cited

U.S. PATENT DOCUMENTS 5,828,346 A * 10/1998 Park ..... 343/826
6,549,170 B1 * 4/2003 Kuo et al. ..... 343/702
6,624,790 B1 * 9/2003 Wong et al. ..... 343/702

(Continued)

FOREIGN PATENT DOCUMENTS

EP 1 039 576 A1 9/2000

(Continued)

OTHER PUBLICATIONS

European Patent Office Action of Jul. 18, 2007 in EP Application 04 028 215.4-2220, 4 pages.

(Continued)

*Primary Examiner*—Douglas W Owens
*Assistant Examiner*—Chuc D Tran
(74) *Attorney, Agent, or Firm*—Harrity & Harrity, LLP

(57) ABSTRACT

A communication device is provided, which includes a circuit board having first and second sides that are substantially straight in the area in which the first and second sides meet to form a corner at an angle of less than 180°; a ground plane extending between the first and the second sides, except in a particular area of the corner of the circuit board; a radiating antenna element disposed in the particular area; and an electrical connection to feed the radiating antenna element across an interface between the ground plane and the particular area.

17 Claims, 2 Drawing Sheets

U.S. PATENT DOCUMENTS

| | | | | |
|---|---|---|---|---|
| 6,707,427 | B2 * | 3/2004 | Konishi et al. | 343/700 MS |
| 7,245,259 | B2 * | 7/2007 | Puckey et al. | 343/700 MS |
| 7,274,334 | B2 * | 9/2007 | O'Riordan et al. | 343/702 |
| 2003/0043081 | A1 | 3/2003 | Achim | |
| 2003/0132882 | A1 | 7/2003 | Wong et al. | |
| 2003/0132883 | A1 * | 7/2003 | Wong et al. | 343/702 |
| 2004/0017315 | A1 * | 1/2004 | Fang et al. | 343/700 MS |
| 2004/0125020 | A1 | 7/2004 | Hendler et al. | |

FOREIGN PATENT DOCUMENTS

| | | | |
|---|---|---|---|
| EP | 1 050 922 | A2 | 11/2000 |
| EP | 1 198 027 | A1 | 4/2002 |
| WO | WO 2005/062422 | A1 | 7/2005 |

OTHER PUBLICATIONS

International Search Report for PCT/EP2005/011512 dated Dec. 29, 2005.

International Preliminary Examination Report for PCT/EP2005/011512 dated Jan. 17, 2007.

* cited by examiner

PORTABLE COMMUNICATION DEVICE WITH ULTRA WIDEBAND ANTENNA

RELATED APPLICATIONS

This application is the national phase under 35 U.S.C. §371 of PCT International Application No. PCT/EP2005/011512 which has an International filing date of Oct. 27, 2005, which designated the United States of America and which claims priority of European Patent Application No. 04028215.4 filed Nov. 29, 2004, and also claims priority under 35 U.S.C. §119 of U.S. Provisional Application Ser. No. 60/633,823 filed Dec. 7, 2004, which are incorporated by reference herein.

TECHNICAL FIELD OF THE INVENTION

The present invention relates to the field of portable communication devices and more particularly to a portable communication device having an antenna arrangement suitable for use in the ultra wide band frequency range as well as such an antenna arrangement.

DESCRIPTION OF RELATED ART

Portable communication devices, like cellular phones, are becoming smaller and smaller, while at the same time providing a multitude functions and features and therefore also have a lot of components provided in them. Some of these functions provide location detection, either indoors or outdoors, as well as short range communication from device to device. Such communication of course needs antennas. It is however of importance that an antenna for such use is as small as possible in order not to occupy too much space within the device.

For this reason there have been proposed a number of small antennas. In for instance US2003/0001793 there is described a chip antenna comprising a base block made of a dielectric material, which includes a helical conductor pattern acting as an antenna element for use in short range communication, like Bluetooth™.

For this type of communication, there has in recent years been investigations regarding the use of the Ultra Wide Band frequency range. One antenna that has proved to have good properties for this type of communication is the discone antenna. However, a discone antenna is big and bulky and not suitable for use in a small portable communication device.

It would thus be interesting to provide an alternative antenna arrangement for this frequency range that occupies little space in a portable communication device.

SUMMARY OF THE INVENTION

The present invention is directed towards solving the problem of providing a communication solution that occupies little space and is suitable for use in the Ultra Wide Band frequency range.

One object of the present invention is thus to provide a portable communication device having a communication structure that occupies little space and is suitable for use in the Ultra Wide Band frequency range.

According to a first aspect of the present invention, this object is achieved by a portable communication device comprising:

a circuit board having two sides that are straight, at least in an area where they meet at an angle below one hundred and eighty degrees for forming a corner, a ground plane extending between said two sides except for a free area at the corner of the circuit board, and a radiating antenna element provided in the free area at the corner.

A second aspect of the present invention is directed towards a portable communication device including the features of the first aspect, wherein the free area is formed as a triangle.

A third aspect of the present invention is directed towards a portable communication device including the features of the second aspect, further comprising an electrical connection feeding the antenna across a borderline between the ground plane and the free area.

A fourth aspect of the present invention is directed towards a portable communication device including the features of the third aspect, wherein the electrical connection is provided across the middle of the borderline.

A fifth aspect of the present invention is directed towards a portable communication device including the features of the fourth aspect, wherein the electrical connection is provided at right angles to the borderline.

A sixth aspect of the present invention is directed towards a portable communication device including the features of the first aspect, wherein the ground plane comprises a section formed as a triangle with a truncated top, which truncated top faces the free area.

A seventh aspect of the present invention is directed towards a portable communication device including the features of the first aspect, wherein the ground plane covers the whole board except for said free area.

An eighth aspect of the present invention is directed towards a portable communication device including the features of the first aspect, further comprising a radio communication circuit on the board, wherein the radiating antenna element is connected to the radio communication circuit via an electrical connection that is isolated from the ground plane.

A ninth aspect of the present invention is directed towards a portable communication device including the features of the first aspect wherein said sides of the board have lengths that are longer than a quarter of a certain frequency, which frequency is the lowest frequency of a band the antenna is intended to be used in.

A tenth aspect of the present invention is directed towards a portable communication device including the features of the first aspect wherein the radiating antenna element has a meandering shape.

An eleventh aspect of the present invention is directed towards a portable communication device including the features of the first aspect, wherein the radiating antenna element has a helical shape.

A twelfth aspect of the present invention is directed towards a portable communication device including the features of the eleventh aspect, wherein the radiating antenna element has a three-dimensional structure.

A thirteenth aspect of the present invention is directed towards a portable communication device including the features of the twelfth aspect, wherein the radiating antenna element is provided in a component made of ceramic or dielectric material.

A fourteenth aspect of the present invention is directed towards a portable communication device including the features of the first aspect, wherein the radiating antenna element has a two-dimensional shape.

A fifteenth aspect of the present invention is directed towards a portable communication device including the features of the fourteenth aspect, wherein the radiating antenna element is printed on the circuit board.

A sixteenth aspect of the present invention is directed towards a portable communication device including the features of the first aspect, wherein the radiating antenna element is a monopole antenna element.

A seventeenth aspect of the present invention is directed towards a portable communication device including the features of the first aspect, wherein it is a cellular phone.

Another object of the present invention is to provide an antenna arrangement that occupies little space and is suitable for use in the Ultra Wide Band frequency range.

According to an eighteenth aspect of the present invention, this object is achieved by an antenna arrangement comprising:

- a ground plane comprising a section formed as a triangle with a truncated top, which truncated top faces a free area, and
- a radiating antenna element provided in the free area, which free area when combined with said section of the ground plane forms a complete triangle, and
- an electrical connection feeding the antenna across a borderline between the ground plane and the free area.

A nineteenth aspect of the present invention is directed towards an antenna arrangement including the features of the eighteenth aspect, wherein the electrical connection is provided across the middle of the borderline.

A twentieth aspect of the present invention is directed towards a portable communication device including the features of the nineteenth aspect, wherein the electrical connection is provided at right angles to the borderline.

The invention has the following advantages. It occupies very limited additional space within the device. The biggest part of the communicative elements is the ground plane. However, since this is often provided in a device anyway. The antenna arrangement according to the present invention does not add to the size of the portable communication device. It is therefore also cheap to produce. The present invention is furthermore suitable for ultra wideband frequency communication while at the same providing good wideband properties. The communication can then be used for location detection, for instance indoors, or short range communication between different devices that enable a high data transmission rate.

The expression radiating antenna element is intended to mean an antenna element that is capable of sending and receiving radio signals irrespective of if it is used for only sending, only receiving or a combination of both.

It should be emphasized that the term "comprises/comprising" when used in this specification is taken to specify the presence of stated features, integers, steps or components, but does not preclude the presence or addition of one or more other features, integers, steps, components or groups thereof.

BRIEF DESCRIPTION OF THE DRAWINGS

The present invention will now be described in more detail in relation to the enclosed drawings, in which.

DETAILED DESCRIPTION OF EMBODIMENTS

A portable communication device according to the present invention will now be described in relation to a cellular phone, which is a preferred variation of the invention. The phone is furthermore preferably a so-called stick-type phone, but it can be other types of phones like clamshell phones. The portable communication device can also be another type of device, like a cordless phone, a communication module, a PDA or a lap top computer or any other type of portable device communicating with radio waves.

Figure 1:
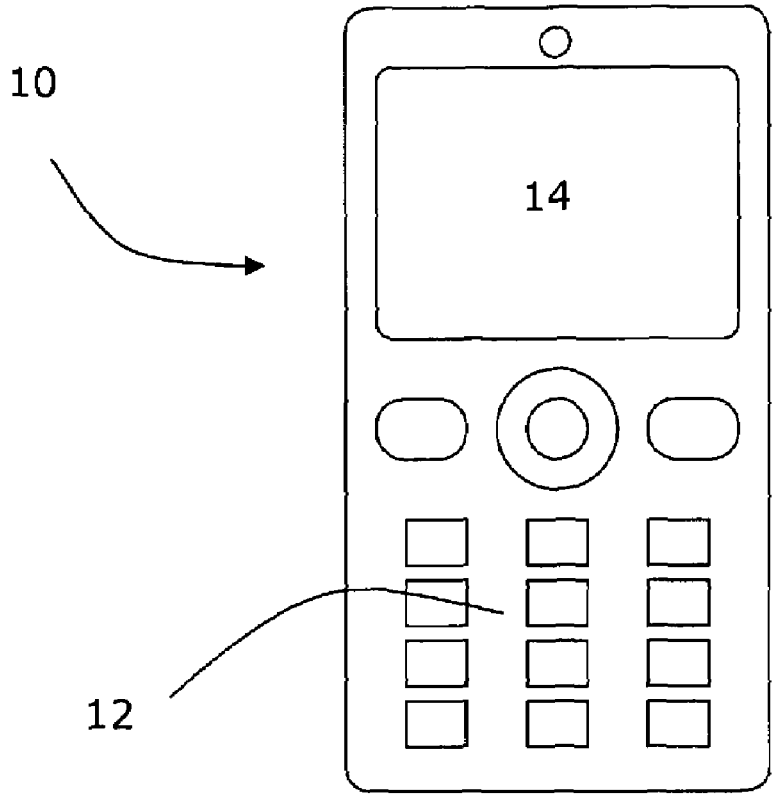
FIG. 1 schematically shows a front view of a portable communication device in the form a cellular phone.

FIG. 1 schematically shows a front view of a phone 10 according to the present invention. The phone 10 includes a display 14, a number of keys on a keypad 12 provided below the display as well as a sound aperture provided above the display 14.

Figure 2:
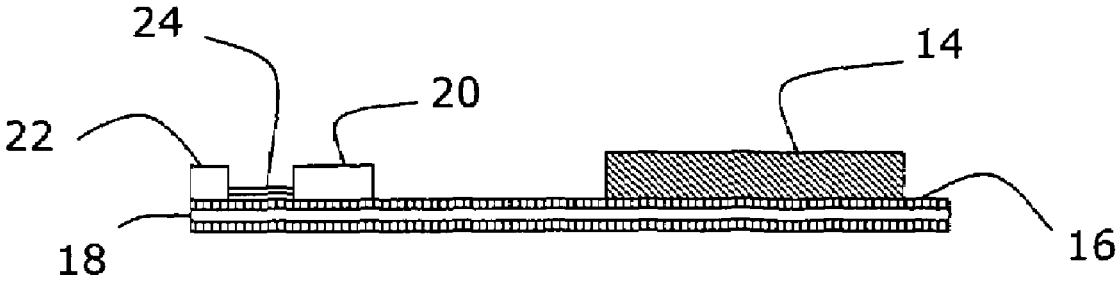
FIG. 2 shows a side view of a circuit board and components placed thereon in the phone in FIG. 1.

FIG. 2 schematically shows a side view of the parts of the interior of the phone that are relevant to the present invention. The phone includes a circuit board 16, in which there is provided as ground plane 18. This ground plane is provided as a layer within the circuit board 16 and essentially stretches through the whole of the circuit board 16, with some exceptions that will be further described later. This ground plane 18 serves as ground for the components placed on the circuit board. However it also serves as ground for antennas in the phone, like for a telecommunication antenna that may be a PIFA antenna (not shown). On the board 16, there is also provided another component, which here is the display 14, a radio communication circuit 20 as well as a component in the form of a dielectric cube 22 comprising a radiating antenna element to be used for short range communication in the Ultra Wide Band frequency range. The radiating antenna element in the cube 22 is connected to the radio communication unit via a coaxial cable 28.

As mentioned earlier a discone antenna has a suitable structure for communication in the Ultra Wide Band frequency range, which range is between 3.1 GHz and 10.6 GHz. A discone antenna is made up of a cone at the top of which is provided a radiating element in the form of a circular plate. The circular plate is fed by a coaxial cable provided through the centre of the cone. The cone, which is grounded, is thus separated from the radiating plate. However the size of this antenna structure is too large for most communication applications where a limited space is available. It is therefore interesting to try to modify the structure of the discone, such that it can be used for smaller devices. Such a modification is shown in FIG. 3.

Figure 3:
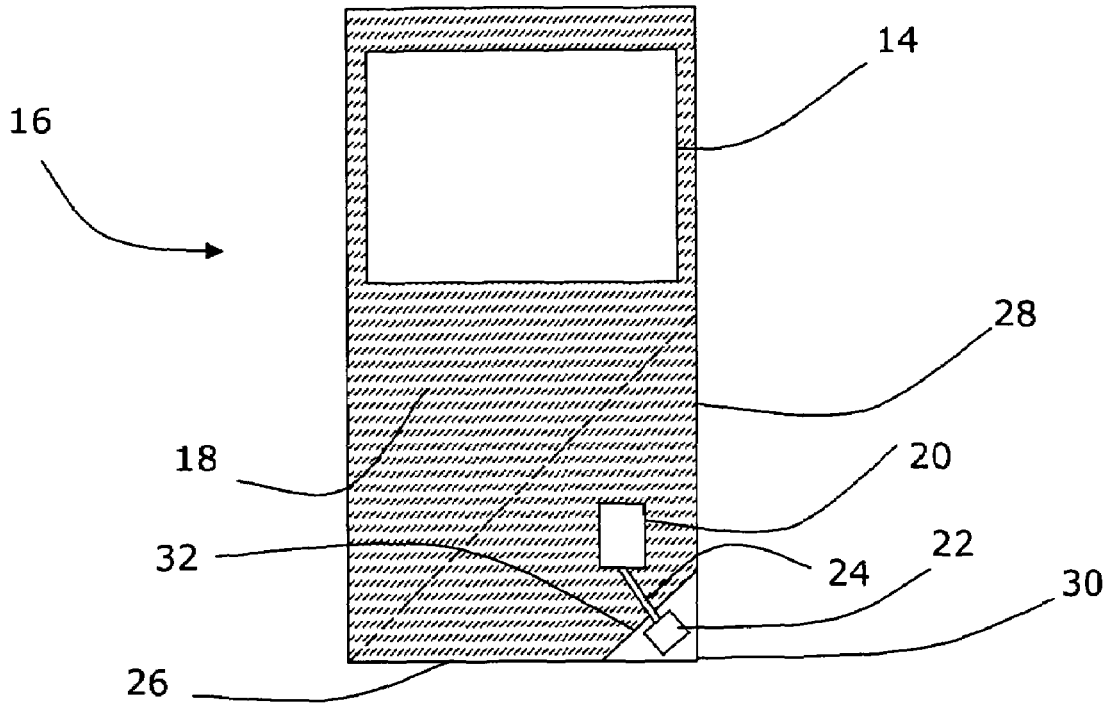
FIG. 3 shows a front view of the circuit board with components placed thereon, FIG. 4 schematically shows a perspective view of a dielectric cube including a radiating antenna element used in the portable communication device according to a first embodiment of the present invention, and FIG. 5 schematically shows of perspective view of a radiating antenna element used in the portable communication device according to a second embodiment of the present invention.

FIG. 3 shows a top view of the circuit board 16. On the board are shown the components 14, 20 and 22 as well as the coaxial cable 24. The ground plane 18 is also shown indicated by hatched lines. From the figure it would appear that the components are provided on the ground plane. This is not the case. The ground plane is in reality provided in a layer within the board, but it is shown here in order to better describe the present invention.

As is apparent from FIG. 3, the circuit board 16 has a straight lower side 26 and a straight long side 28 that join each other at right angles for defining a corner 30. As is also apparent from this figure, the ground plane 18 covers essentially the whole circuit board 16 except for a free area at this corner 30, where this free area is in the shape of a triangle. The ground plane 18 thus has the shape of a modified rectangle, where one corner has been truncated. The truncation is furthermore symmetrical so that the same amount of free space is provided along the lower side 26 and the long side 28 at the corner 30. This means that the ground plane 18 has a side or borderline 32 facing the corner 30 forming the hypotenuse of the triangle that forms the free area. In the free area, and preferably in the middle of it, the dielectric cube 22 including the radiating antenna element is provided. The coaxial cable 24 stretches from the board to the free area crossing the side 32 at right angles for interconnecting the communication unit 20 and the dielectric cube 30. The radiating antenna element in the dielectric cube has a length that corresponds to a quarter of a wavelength of the lowest frequency in the frequency band used, which is also denoted a cut frequency. How this radiating antenna element inside the cube 22 can be provided will shortly be described in more detail. The ground plane and the dielectric cube with the radiating antenna element here make up an antenna arrangement, where the coaxial cable can be though as being included in the antenna arrangement or as a part of the feeding of the antenna arrangement.

The lower side 26 typically has a length that is longer than the cut frequency as does the long side 28. It is furthermore advantageous to have the display 14 placed as far apart from the dielectric cube 22 as possible, since the display 14 may absorb some radiation of the antenna. The material of the free area should furthermore have good conductive quality.

With the above described structure the ground plane can be seen as providing two sections, where one section is a triangle section with a truncated top, where the truncated top faces the corner. This division into two sections of the ground plane is indicated by a dashed line in FIG. 3. The triangular section represents a two-dimensional version of the cone in a discone antenna, where the radiating element corresponds to the radiating disc of the discone antenna. In this way a small sized antenna corresponding to a discone antenna is provided, which is suitable for ultra wideband communication while at the same time providing good wideband properties. The triangle section with a truncated top furthermore makes up a complete triangle together with the free area.

By placing the dielectric cube with the radiating antenna element in the middle of the free area and feeding it over the middle of side 32, the antenna is furthermore symmetrical.

With an antenna of the type described above it is possible to provide communication in the ultra wide band frequency range and then preferably within 3.1-4.8 GHz. The communication can then be used for location detection, for instance indoors, short range communication between different devices that enable a high data transmission rate or inter-chip communications. The Ultra Wide Band range has a number of advantages. It has small interference, good floor and wall penetration, high location resolution and low power. The radio communication circuit used is furthermore cheap to produce. The antenna arrangement according to the invention is furthermore very small and does not add much additional material, since a ground plane is often provided in a device anyway. It is therefore also cheap.

The radiating antenna element within the dielectric cube can have a number of shapes in order to provide the required length at the limited free area available.

Figure 4:
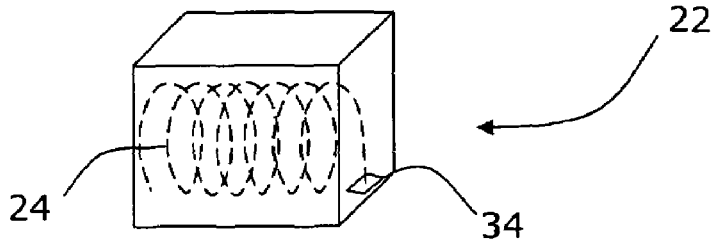

FIG. 4 shows a perspective view of the cube 22, which may be a ceramic cube, including a helical monopole antenna element according to a first presently contemplated preferred embodiment of the present invention. To an end of the radiating antenna element 24 there is provided a contact pad 34, which is intended to be soldered to the circuit board for connection to the coaxial cable. The radiating antenna element is here provided in the interior of the cube using a multilayer cube forming technique. As can be seen the radiating antenna element here has a three-dimensional structure. As an alternative the radiating antenna element can also have another shape like a meandering shape. The cube can furthermore be fixed to the circuit board in a multitude of ways for instance through gluing or through soldering certain contact pads to the board. The latter approach has the advantage of providing the fastening in the same step as the necessary electrical contacting is made. The radiating antenna element could as an alternative be provided on the outside of the cube, using for instance printing technique. The feeding of the radiating antenna element could as an alternative also be performed in the middle of the element.

Figure 5:
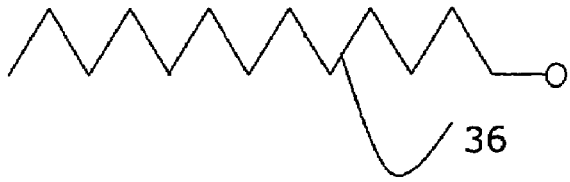

FIG. 5 shows another variation of the radiating antenna element 36 according to a second embodiment of the present invention, which is two-dimensional and having a meandering shape. Here the radiating antenna element is provided in two dimensions. This antenna element, which is also a monopole antenna element, can be provided directly on the circuit board for example via printing. In the figure the element is fed from one end, but it could also be fed from the middle.

The portable communication device according to the present invention can be varied in a number of ways apart from what has been disclosed above. The dielectric cube can have any shape that fits into the free area, and thus also have triangular shape. The feeding of the radiating antenna element does not have to be provided using coaxial cable. Any means of connecting is possible as long as the signal conductor is isolated from ground, which can be provided by a gap between ground and the signal conductor. By providing the radiating antenna element and ground plane in a larger device, like in a lap top computer, it is possible to get the free area in the corner bigger while at the same time allowing a larger ground plane. Then the radiating antenna element can also be provided without the structures above and for instance be provided with a T shape. Then it is possible to get good antenna properties in the whole frequency band, i.e. up to 10.6 GHz. The sides do furthermore not have to be straight all the way, but only in the areas where the ground plane provides a triangle with a truncated top. The angle formed by the lower and long sides does furthermore not have to be ninety degrees, but can be anything below one hundred and eighty degrees. It should furthermore be realised that the antenna is not limited to the Ultra Wide Band frequency range, but other frequencies may be contemplated.

The invention claimed is:

1. A communication device comprising:

a circuit board including a first side and a second side that are substantially straight in at least a first area in which the first and second sides meet to form a corner at an angle of less than 180°;

a ground plane extending between the first and the second sides except in a second area of the corner of the circuit board;

a radiating antenna element provided in the second area, where the first and second side of the second area have lengths greater than ¼ of a wavelength of a lowest frequency of a band of operable frequencies associated with the radiating antenna element; and an electrical connection to feed the radiating antenna element across an interface between the ground plane and the second area.

2. The communication device of claim 1, where the electrical connection is provided across a midline of the interface.

3. The communication device of claim 2, where the electrical connection is provided at right angles to the interface.

4. The communication device of claim 1, where the ground plane comprises a section formed as a triangle with a truncated top that faces the second area.

5. The communication device of claim 1, where the ground plane covers an entirety of the board except for the second area.

6. The communication device of claim 1, further comprising:

a radio communication circuit on the circuit board, where the radiating antenna element connects to the radio communication circuit via the electrical connection, and the electrical connection is isolated from the ground plane.

7. The communication device of claim 1, where the radiating antenna element is of a meandering shape.

8. The communication device of claim 1, where the radiating antenna element is of a helical shape.

9. The communication device of claim 1, where the radiating antenna element is of a three-dimensional structure.

10. The communication device of claim 9, where the radiating antenna element is provided in a component made from at least one of ceramic or dielectric material.

11. The communication device of claim 1, where the radiating antenna element is of a two-dimensional shape.

12. The communication device of claim 11, where the radiating antenna element is printed on the circuit board.

13. The communication device of claim 1, where the radiating antenna element comprises a monopole antenna element.

14. The communication device of claim 1, where the communication device is a mobile phone.

15. An antenna arrangement comprising:

a ground plane including a first side and a second side and forming a triangular-shaped section having a truncated top facing a free area shaped as a triangle;

a radiating antenna element provided in the free area, where the free area together with the triangular-shaped section of the ground plane forms a complete triangle; and an electrical connection to feed the radiating antenna element across an interface between the ground plane and the free area, where the first and second side of the free area have lengths greater than ¼ of a wavelength of a lowest frequency of a band of operable frequencies associated with the radiating antenna element.

16. The antenna arrangement of claim 15, where the electrical connection is provided across a midline of the interface.

17. The antenna arrangement of claim 16, where the electrical connection is provided at right angles to the interface.

* * * * *